US007051388B1

(12) United States Patent
Taddeo

(10) Patent No.: US 7,051,388 B1
(45) Date of Patent: May 30, 2006

(54) STAY-PUT SHEET COVERS

(76) Inventor: Robert Taddeo, 12 Cauldwell St., Eastchester, NY (US) 10709

( * ) Notice: Subject to any disclaimer, the term of this patent is extended or adjusted under 35 U.S.C. 154(b) by 62 days.

(21) Appl. No.: 10/885,920

(22) Filed: Jul. 8, 2004

(51) Int. Cl.
*A47C 21/02* (2006.01)

(52) U.S. Cl. ..... 5/498; 5/925; 5/486

(58) Field of Classification Search ..... 5/925, 5/486, 691, 495–499
See application file for complete search history.

(56) References Cited

U.S. PATENT DOCUMENTS

| | | | | |
|---|---|---|---|---|
| 2,499,698 | A * | 3/1950 | Thomas | 5/499 |
| 3,581,322 | A * | 6/1971 | Marsico | 5/699 |
| 3,611,524 | A * | 10/1971 | Broyles | 29/21.1 |
| 4,672,702 | A | 6/1987 | Isham | |
| 5,111,544 | A * | 5/1992 | Graebe | 5/654 |
| 5,136,741 | A * | 8/1992 | Balonick et al. | 5/738 |
| 5,621,931 | A * | 4/1997 | Hamilton | 5/493 |
| 5,745,940 | A * | 5/1998 | Roberts et al. | 5/727 |
| 5,996,148 | A | 12/1999 | McCain et al. | |
| 6,212,717 | B1 * | 4/2001 | Cooper | 5/653 |
| 6,276,009 | B1 | 8/2001 | Schrougham | |
| 6,381,778 | B1 * | 5/2002 | Peterson | 5/497 |

* cited by examiner

*Primary Examiner*—Patricia L. Engle
*Assistant Examiner*—Gilbert Lee
(74) *Attorney, Agent, or Firm*—Wood, Ngo & Eisenberg, PLLC

(57) ABSTRACT

A bedding system for inhibiting sheets being inadvertently pulled out from between a mattress and a box spring. The bedding system includes a pair of cover members comprising a main portion and a friction enhancing portion. The main portion of one of the cover members is designed for receiving the mattress whereby the main portion of the other one of the cover members is for receiving the box spring. The friction enhancing portion of one of the cover members engages the friction enhancing portion of the other one of the cover members whereby the friction enhancing portion of each of the cover members is designed for frictionally engaging a portion of the sheets positioned between the mattress and the box spring to inhibit the portion of the sheets from inadvertently sliding out from between the mattress and the box spring.

10 Claims, 2 Drawing Sheets

STAY-PUT SHEET COVERS

BACKGROUND OF THE INVENTION

The present invention relates to mattress coverings and more particularly pertains to a new bedding system for inhibiting sheets being inadvertently pulled out from between a mattress and a box spring.

DESCRIPTION OF THE PRIOR ART

The use of mattress coverings is known in the prior art. More specifically, mattress coverings heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples of such devices include: U.S. Pat. No. 4,672,702; U.S. Pat. No. 5,996,148; and U.S. Pat. No. 6,276,009.

In these respects, the bedding system according to the present invention substantially departs from the conventional concepts and designs of the prior art, and in so doing provides an apparatus primarily developed for the purpose of inhibiting sheets being inadvertently pulled out from between a mattress and a box spring.

SUMMARY OF THE INVENTION

In view of the foregoing disadvantages inherent in the known types of mattress coverings now present in the prior art, the present invention provides a new bedding system construction wherein the same can be utilized for inhibiting sheets being inadvertently pulled out from between a mattress and a box spring.

To attain this, the present invention generally comprises a pair of cover members comprising a main portion and a friction enhancing portion. The main portion of one of the cover members is designed for receiving the mattress whereby the main portion of the other one of the cover members is for receiving the box spring. The friction enhancing portion of one of the cover members engages the friction enhancing portion of the other one of the cover members whereby the friction enhancing portion of each of the cover members is designed for frictionally engaging a portion of the sheets positioned between the mattress and the box spring to inhibit the portion of the sheets from inadvertently sliding out from between the mattress and the box spring.

There has thus been outlined, rather broadly, the more important features of a mattress cover in order that the detailed description thereof that follows may be better understood, and in order that the present contribution to the art may be better appreciated. There are additional features of the mattress cover that will be described hereinafter and which will form the subject matter of the claims appended hereto.

In this respect, before explaining at least one embodiment of the mattress cover in detail, it is to be understood that the mattress cover is not limited in its application to the details of construction and to the arrangements of the components set forth in the following description or illustrated in the drawings. The mattress cover is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the mattress cover. It is important, therefore, that the claims be regarded as including such equivalent constructions insofar as they do not depart from the spirit and scope of the present invention.

It is therefore an object of present invention is to provide a new mattress cover that includes a friction enhancing portion to frictionally engage bed sheets and resist movement of the bed sheets.

It is another object of the present invention to provide a mattress cover which has all of the advantages of the prior art and none of the disadvantages.

It is another object of the present invention to provide a mattress cover which may be easily and efficiently manufactured and marketed.

It is another object of the present invention to provide a mattress cover which is of durable and reliable construction.

It is yet another object of the present invention to provide a mattress cover which is economically affordable and available for relevant market segment of the purchasing public.

Other objects, features and advantages of the present invention will become more readily apparent from the following detailed description of the preferred embodiment when considered with the attached drawings and appended claims.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF THE PREFERRED EMBODIMENT

Figure 1:
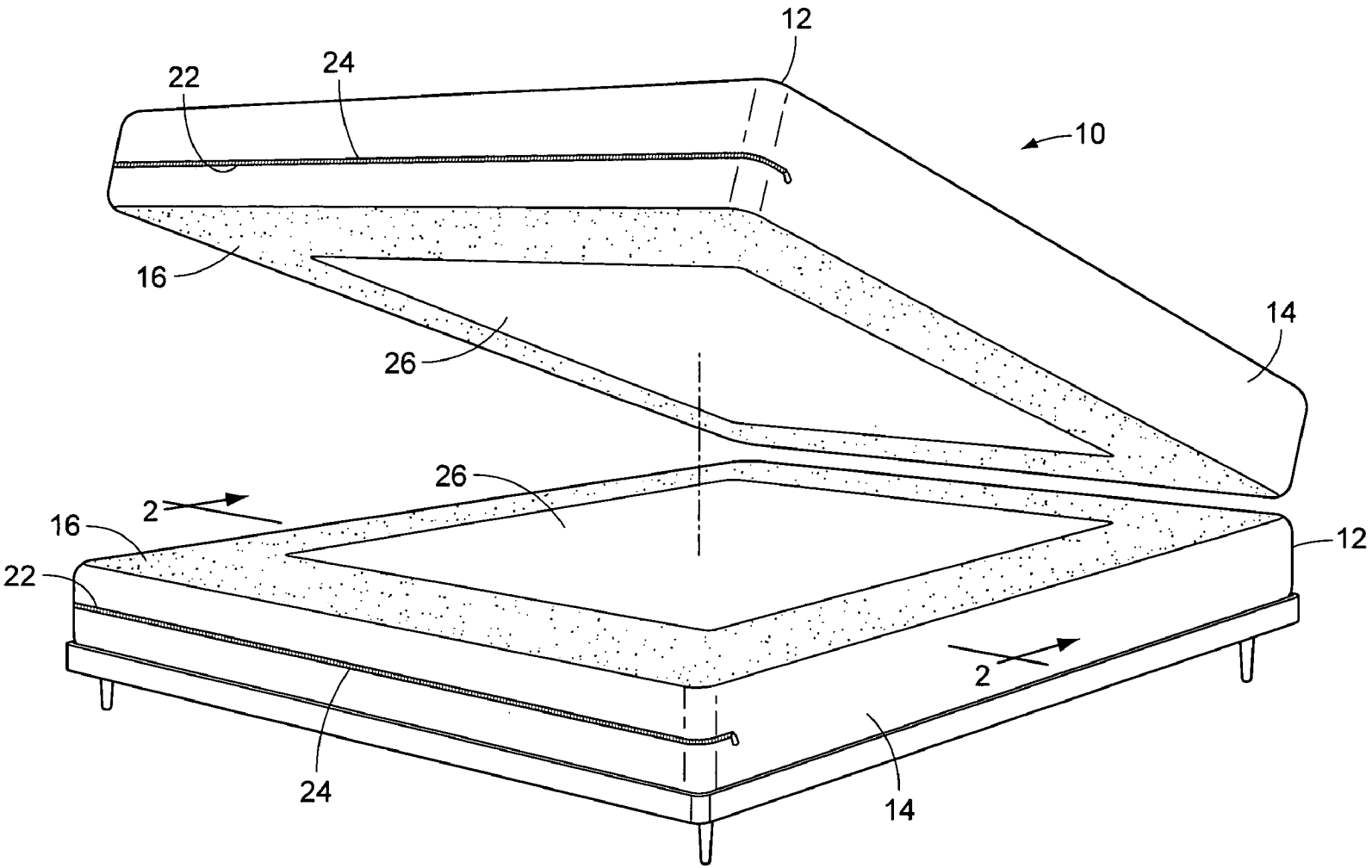
FIG. 1 is an exploded perspective view of a new bedding system according to the present invention shown in use.
Figure 2:
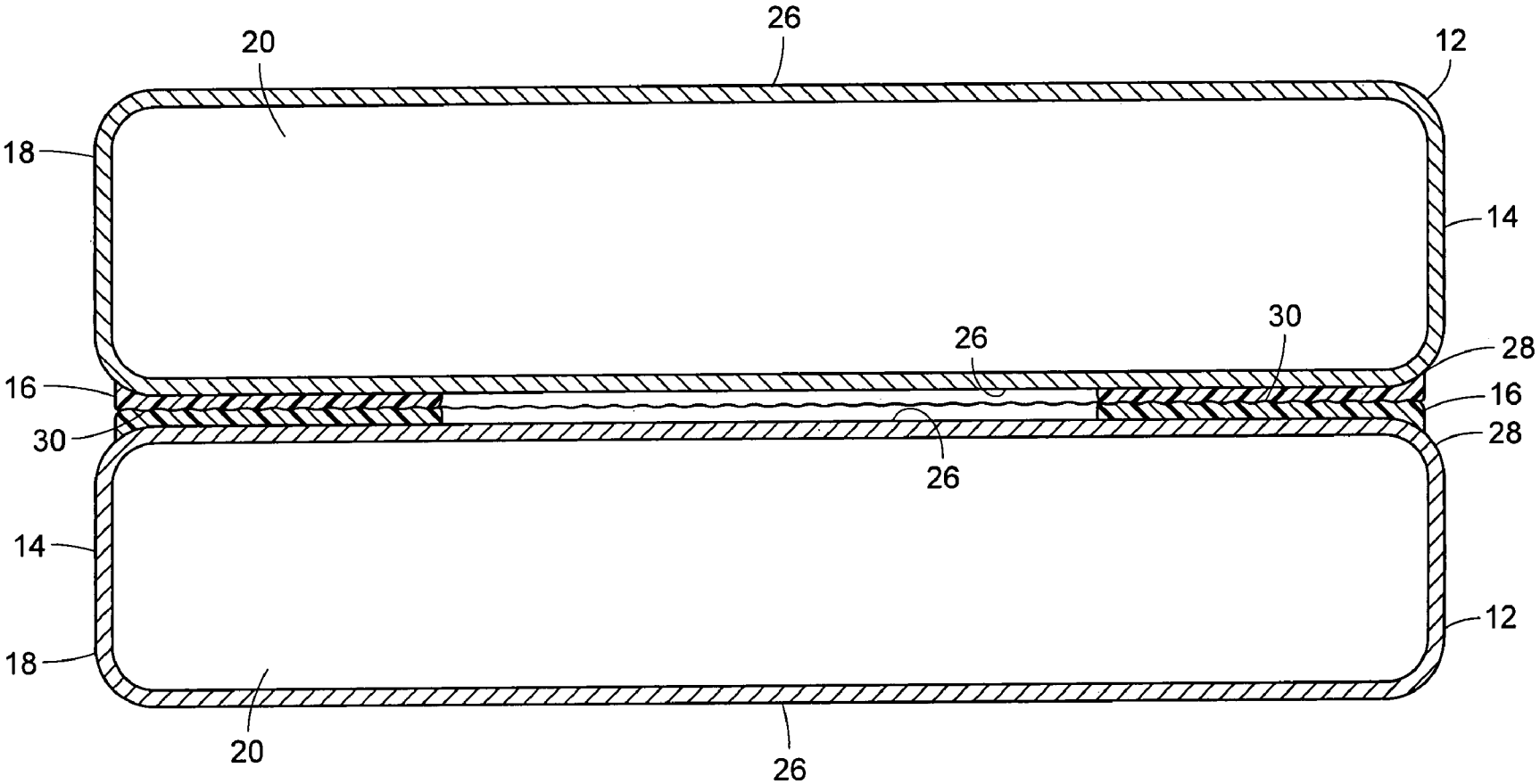
FIG. 2 is a cross-sectional view of the present invention taken along line 2—2 of FIG. 1.

With reference now to the drawings, and in particular to FIGS. 1 and 2 thereof, a new bedding system embodying the principles and concepts of the present invention and generally designated by the reference numeral 10 will be described.

As best illustrated in FIGS. 1 and 2, the bedding system 10 generally comprises a pair of cover members 12 comprising a main portion 14 and a friction enhancing portion 16. The main portion 14 of one of the cover members 12 is designed for receiving the mattress whereby the main portion 14 of the other one of the cover members 12 is for receiving the box spring. The friction enhancing portion 16 of one of the cover members 12 engages the friction enhancing portion 16 of the other one of the cover members 12 whereby the friction enhancing portion 16 of each of the cover members 12 is designed for frictionally engaging a portion of the sheets positioned between the mattress and the box spring to inhibit the portion of the sheets from inadvertently sliding out from between the mattress and the box spring. The main portion 14 of each of the cover members 12 may comprises of vinyl, plastic or cotton material. The main portion 14 of each of the cover members 12 comprises a perimeter wall 18. The perimeter wall 18 defines an interior space 20 of the associated one of the main portion 14. The interior space 20 comprises an open end 22 whereby the open end 22 is designed for permitting an object to be inserted into the interior space 20 of the main portion 14 of the associated one of the cover member. The interior space 20 of one of the cover members 12 is designed for receiving the mattress whereby the interior space 20 of the other one of the cover members 12 is for receiving the box spring.

Each of the cover members 12 comprises a closure member 24, such as a zipper. The closure member 24 is coupled to the main portion 14 adjacent the open end 22 of the interior space 20 whereby the closure member 24 selectively closes the open end 22 to secure the object in the interior space 20 when the closure member 24 is actuated by a user.

The friction enhancing portion 16 of each of the cover members 12 comprises a friction enhancing material. The friction enhancing material is designed for frictionally engaging the portion of the sheets positioned between the mattress and the box spring to inhibit inadvertent removal of the portion of the sheets for between the mattress and the box spring.

The friction enhancing material comprises a polymeric material, such as rubber. The polymeric material having a high coefficient of friction to frictionally engage the sheets.

The main portion 14 of each of the cover members 12 comprises a pair of lateral faces 26. One of the lateral faces 26 is positioned opposite the other one of the lateral faces 26 of the associated one of the cover members 12. The friction enhancing portion 16 is positioned around a perimeter edge 28 of one of the lateral faces 26 of the associated one of the cover members 12. The friction enhancing portion 16 of one of the cover members 12 is abutted against the friction enhancing portion 16 of the other one of the cover members 12 when the mattress is positioned on the box spring.

The friction enhancing portion 16 of each of the cover members 12 comprises an undulating surface 30. The undulating surface 30 of the friction enhancing portion 16 of one of the cover members 12 is complimentary to the undulating surface 30 of the friction enhancing portion 16 of the other one of the cover members 12 to inhibit the inadvertent withdrawal of the portions of the sheets positioned between the mattress and the box spring.

In use, the closure member 24 of each of the cover members 12 is actuated to allow the open end 22 of the associated one of the cover members 12 to be opened. The mattress is slid into the open end 22 of one of the cover members 12 and the associated one of the cover members 12 is slid over the mattress whereby the mattress is positioned in the interior space 20 of the associated one of the cover members 12. The box spring is slid into the open end 22 of the other one of the cover members 12 and the associated one of the cover members 12 is slid over the box spring whereby the box spring is positioned in the interior space 20 of the associated one of the cover members 12. The closure member 24 of the cover members 12 is actuated to close the open end 22 of each of the cover members 12. The mattress is positioned on the box spring whereby the friction enhancing portion 16 of the one of the cover members 12 over the box spring is abutted by the friction enhancing portion 16 of the one of the cover members 12 over the mattress. A portion of the sheets are tucked between the mattress and the box spring whereby the friction enhancing portion 16 of each of the cover members 12 frictionally engages the portions of the sheets positioned between the mattress and the box spring to inhibit the sheets being inadvertently removed from between the mattress and the box spring.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In one aspect of the invention, a method is provided for inhibiting sheets being pulled out from between a box spring and a mattress comprising:

(a) providing a bedding system comprising:

(i) a pair of cover members comprising a main portion and a friction enhancing portion, the main portion of one of the cover members being adapted for receiving the mattress such that the main portion of the other one of the cover members is for receiving the box spring, the friction enhancing portion of one of the cover members engaging the friction enhancing portion of the other one of the cover members such that the friction enhancing portion of each of the cover members is adapted for frictionally engaging a portion of the sheets positioned between the mattress and the box spring to inhibit the portion of the sheets from inadvertently sliding out from between the mattress and the box spring, (ii) wherein the main portion of each of the cover members comprises a perimeter wall, the perimeter wall defining an interior space of the main portion, the interior space comprising an open end such that the open end is adapted for permitting an object to be inserted into the interior space of the main portion of the associated one of the cover members, the interior space of one of the cover members being adapted for receiving the mattress such that the interior space of the other one of the cover members is for receiving the box spring, (iii) further wherein each of the cover members comprises a closure member, the closure member being coupled to the main portion adjacent the open end of the interior space such that the closure member selectively closes the open end to secure the object in the interior space when the closure member is actuated by a user, (iv) further wherein the friction enhancing portion of each of the cover members comprises a friction enhancing material, the friction enhancing material being adapted for frictionally engaging the portion of the sheets positioned between the mattress and the box spring to inhibit inadvertent removal of the portion of the sheets between the mattress and the box spring, (v) further wherein the main portion of each of the cover members comprises a pair of lateral faces, one of the lateral faces being positioned opposite the other one of the lateral faces of the associated one of the cover members, the friction enhancing portion being positioned around a perimeter edge of one of the lateral faces of the associated one of the cover members, the friction enhancing portion of one of the cover members being abutted against the friction enhancing portion of the other one of the cover members when the mattress is positioned on the box spring, (vi) further wherein the friction enhancing portion of each of the cover members comprises an undulating surface, the undulating surface of the friction enhancing portion of one the cover members being complimentary to the undulating surface of the friction enhancing portion of the other one of the cover members to inhibit the inadvertent withdrawal of the portions of the sheets positioned between the mattress and the box spring, (b) actuating of the closure member of each of the cover members to allow the open end of the associated one of the cover members to be opened, (c) sliding of the mattress into the open end of one of the cover members and sliding the associated one of the cover members over the mattress such that the mattress is positioned in the interior space of the associated one of the cover members, (d) sliding of the box spring into the open end of the other one of the cover members and sliding the associated one of the cover members over the box spring such that the box spring is positioned in the interior space of the associated one of the cover members, (e) actuating the closure member of the cover members to close the open end of each of the cover members, (f) positioning of the mattress on the box spring such that the friction enhancing portion of the one of the cover members over the box spring is abutted by the friction enhancing portion of one of the cover members over the mattress, (g) tucking a portion of the sheets between the mattress and the box spring such that the friction enhancing portion of each of the cover members frictionally engages the portions of the sheets positioned between the mattress and the box spring to inhibit the sheets inadvertently removed from between the mattress and the box spring.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bedding system for inhibiting sheets on a bed from slipping out between a mattress and a box spring of the bed, the bedding system comprising a pair of cover members comprising a main portion defined by opposed top and bottom panels joined together by a perimeter wall to form a closed interior space there between and a friction enhancing portion, said main portion of one of said cover members being adapted for receiving the mattress such that said main portion of the other one of said cover members is for receiving the box spring, said friction enhancing portion of one of said cover members engaging said friction enhancing portion of the other one of said cover members such that said friction enhancing portion of each of said cover members is adapted for frictionally engaging a portion of the sheets positioned between the mattress and the box spring to inhibit the portion of the sheets from inadvertently sliding out from between the mattress and the box spring.

2. A bedding system for inhibiting sheets on a bed from slipping out between a mattress and a box spring of the bed, the bedding system comprising a pair of cover members comprising a main portion defined by opposed top and bottom panels joined together by a perimeter wall to form a closed interior space there between and a friction enhancing portion, said main portion of one of said cover members being adapted for receiving the mattress such that said main portion of the other one of said cover members is for receiving the box spring, said friction enhancing portion of one of said cover members engaging said friction enhancing portion of the other one of said cover members such that said friction enhancing portion of each of said cover members is adapted for frictionally engaging a portion of the sheets positioned between the mattress and the box spring to inhibit the portion of the sheets from inadvertently sliding out from between the mattress and the box spring, further wherein said main portion of each of said cover members comprises a perimeter wall, said perimeter wall defining an interior space of said main portion, said interior space comprising an open end such that said open end is adapted for permitting an object to be inserted into said interior space of said main portion of the associated one of said cover members, said interior space of one of said cover members being adapted for receiving the mattress such that said interior space of the other one of said cover members is for receiving the box spring.

3. The bedding system as set forth in claim 2, further wherein each of said cover members comprises a closure member, said closure member being coupled to said main portion adjacent said open end of said interior space such that said closure member selectively closes said open end to secure the object in said interior space when said closure member is actuated by a user.

4. The bedding system as set forth in claim 3, further wherein said closure member of each of said cover members comprises a zipper, said zipper being coupled to main portion around said open end of the associated one of said cover members, said zipper being for selectively closing said open end of the associated one of said cover members when said zipper is actuated by the user.

5. The bedding system as set forth in claim 1, further wherein said friction enhancing portion of each of said cover members comprises a friction enhancing material, said friction enhancing material being adapted for frictionally engaging the portion of the sheets positioned between the mattress and the box spring to inhibit inadvertent removal of the portion of the sheets from between the mattress and the box spring.

6. The bedding system as set forth in claim 5, further wherein said friction enhancing material comprises a polymeric material, said polymeric material having a high coefficient of friction to frictionally engage the sheets.

7. The bedding system as set forth in claim 1, further wherein said main portion of each of said cover members comprises a pair of lateral faces, one of said lateral faces being positioned opposite the other one of said lateral faces of the associated one of said cover members, said friction enhancing portion being positioned around a perimeter edge of one of said lateral faces of the associated one of said cover members, said friction enhancing portion of one of said cover members being abutted against said friction enhancing portion of the other one of said cover members when the mattress is positioned on the box spring.

8. The bedding system as set forth in claim 1, further wherein said friction enhancing portion of each of said cover members comprises an undulating surface, said undulating surface of said friction enhancing portion of one of said cover members being complimentary to said undulating surface of said friction enhancing portion of the other one of said cover members to inhibit the inadvertent withdrawal of the portions of the sheets positioned between the mattress and the box spring.

9. A bedding system for inhibiting sheets on a bed from slipping out between a mattress and a box spring of the bed, the bedding system comprising:

(a) a pair of cover members comprising a main portion and a friction enhancing portion, said main portion of one of said cover members being adapted for receiving the mattress such that said main portion of the other one of said cover members is for receiving the box spring, said friction enhancing portion of one of said cover members engaging said friction enhancing portion of the other one of said cover members such that said friction enhancing portion of each of said cover members is adapted for frictionally engaging a portion of the sheets positioned between the mattress and the box spring to inhibit the portion of the sheets from inadvertently sliding out from between the mattress and the box spring, (b) wherein said main portion of each of said cover members comprises a perimeter wall, said perimeter wall defining an interior space of said main portion, said interior space comprising an open end such that said open end is adapted from permitting an object to be inserted into said interior space of said main portion of the associated one of said cover member, said interior space of one of said cover members being adapted for receiving the mattress such that said interior space of the other one of said cover members is for receiving the box spring, (c) further wherein each of said cover members comprises a closure member, said closure member being coupled to said main portion adjacent said open end of said interior space such that said closure member selectively closes said open end to secure the object in said interior space when said closure member is actuated by a user, (d) further wherein said closure member of each of said cover members comprises a zipper, said zipper being coupled to main portion around said open end of the associated one of said cover members, said zipper being for selectively closing said open end of the associated one of said cover members when said zipper is actuated by the user, (e) further wherein said friction enhancing portion of each of said cover members comprises a friction enhancing material, said friction enhancing material being adapted for frictionally engaging the portion of the sheets positioned between the mattress and the box spring to inhibit inadvertent removal of the portion of the sheets for between the mattress and the box spring, (f) said friction enhancing material comprises a polymeric material, said polymeric material having a high coefficient of friction to frictionally engage the sheets, (g) further wherein said main portion of each of said cover members comprises a pair of lateral faces, one of said lateral faces being positioned opposite the other one of said lateral faces of the associated one of said cover members, said friction enhancing portion being positioned around a perimeter edge of one of said lateral faces of the associated one of said cover members, said friction enhancing portion of one of said cover members being abutted against said friction enhancing portion of the other one of said cover members when the mattress is positioned on the box spring, and (h) further wherein said friction enhancing portion of each of said cover members comprises an undulating surface, said undulating surface of said friction enhancing portion of one of said cover members being complimentary to said undulating surface of said friction enhancing portion of the other one of said cover members to inhibit the inadvertent withdrawal of the portions of the sheets positioned between the mattress and the box spring.

10. A method of inhibiting sheets being pulled out from between a box spring and a mattress comprising:

(a) providing a bedding system comprising:

(i) a pair of cover members comprising a main portion and a friction enhancing portion, said main portion of one of said cover members being adapted for receiving the mattress such that said main portion of the other one of said cover members is for receiving the box spring, said friction enhancing portion of one of said cover members engaging said friction enhancing portion of the other one of said cover members such that said friction enhancing portion of each of said cover members is adapted for frictionally engaging a portion of the sheets positioned between the mattress and the box spring to inhibit the portion of the sheets from inadvertently sliding out from between the mattress and the box spring, (ii) wherein said main portion of each of said cover members comprises a perimeter wall, said perimeter wall defining an interior space of the of said main portion, said interior space comprising an open end such that said open end is adapted for permitting an object to be inserted into said interior space of said main portion of the associated one of said cover member, said interior space of one of said cover members being adapted for receiving the mattress such that said interior space of the other one of said cover members is for receiving the box spring, (iii) further wherein each of said cover members comprises a closure member, said closure member being coupled to said main portion adjacent said open end of said interior space such that said closure member selectively closes said open end to secure the object in said interior space when said closure member is actuated by a user, (iv) further wherein said friction enhancing portion of each of said cover members comprises a friction enhancing material, said friction enhancing material being adapted for frictionally engaging the portion of the sheets positioned between the mattress and the box spring to inhibit inadvertent removal of the portion of the sheets for between the mattress and the box spring, (v) further wherein said main portion of each of said cover members comprises a pair of lateral faces, one of said lateral faces being positioned opposite the other one of said lateral faces of the associated one of said cover members, said friction enhancing portion being positioned around a perimeter edge of one of said lateral faces of the associated one of said cover members, said friction enhancing portion of one of said cover members being abutted against said friction enhancing portion of the other one of said cover members when the mattress is positioned on the box spring, (vi) further wherein said friction enhancing portion of each of said cover members comprises an undulating surface, said undulating surface of said friction enhancing portion of one of said cover members being complimentary to said undulating surface of said friction enhancing portion of the other one of said cover members to inhibit the inadvertent withdrawal of the portions of the sheets positioned between the mattress and the box spring, (b) actuating of said closure member of each of said cover members to allow said open end of the associated one of said cover members to be opened, (c) sliding of the mattress into the open end of one of the cover members and sliding the associated one of said cover members over the mattress such that the mattress is positioned in said interior space of the associated one of said cover members (d) sliding of the box spring into the open end of the other one of the cover members and sliding the associated one of said cover members over the box spring such that the box spring is positioned in said interior space of the associated one of said cover members, (e) actuating said closure member of said cover members to close said open end of each of said cover members, (f) positioning of the mattress and on the box spring such that said friction enhancing portion of the one of said cover members over the box spring is abutted by said friction enhancing portion of the one of said cover members over the mattress, (g) tucking a portion of the sheets between the mattress and the box spring such that said friction enhancing portion of each of said cover members frictionally engages the portions of the sheets positioned between the mattress and the box spring to inhibit the sheets being inadvertently removed from between the mattress and the box spring.

* * * * *